US005462690A

United States Patent [19]

Rhinesmith

[11] Patent Number: 5,462,690

[45] Date of Patent: Oct. 31, 1995

[54] LIQUID CLEANING COMPOSITIONS

[75] Inventor: Robert Rhinesmith, Somerset, N.J.

[73] Assignee: Colgate-Palmolive Co., Piscataway, N.J.

[21] Appl. No.: 303,243

[22] Filed: Sep. 9, 1994

[51] Int. Cl.[6] ..... C11D 1/02; C11D 1/22; C11D 1/72; C11D 3/18

[52] U.S. Cl. ..... 252/126; 252/118; 252/127; 252/358; 252/548; 252/174.21; 252/558

[58] Field of Search ..... 252/548, 153, 252/321, 358, 320, 351.1, 174.21, 174.22, 118, 126, 127, 158, 558

[56] References Cited

U.S. PATENT DOCUMENTS

| | | | |
|---|---|---|---|
| 4,088,598 | 5/1978 | Williams | 252/135 |
| 4,111,854 | 9/1978 | Spadini et al. | 252/541 |
| 4,195,077 | 3/1980 | Marsh et al. | 252/545 |
| 4,414,128 | 11/1983 | Goffinet | 252/111 |
| 4,540,505 | 9/1985 | Frazier | 252/106 |
| 4,690,779 | 1/1987 | Baker et al. | 252/546 |
| 4,790,951 | 12/1988 | Frieser et al. | 252/162 |
| 5,075,026 | 12/1991 | Loth et al. | 252/122 |

FOREIGN PATENT DOCUMENTS

| | | |
|---|---|---|
| 0080749 | 6/1983 | European Pat. Off. . |
| 1603047 | 11/1981 | United Kingdom . |

*Primary Examiner*—Paul Lieberman
*Assistant Examiner*—E. Harriman
*Attorney, Agent, or Firm*—Richard E. Nanfeldt; Robert C. Sullivan; Murray Grill

[57] ABSTRACT

An improvement is described in microemulsion compositions which contain an anionic detergent, a nonionic surfactant, a grease release agent, a hydrocarbon ingredient, and water which comprises the use of a water-insoluble odoriferous perfume as the essential hydrocarbon ingredient in a proportion sufficient to form either a dilute o/w microemulsion composition containing, by weight, 1% to 20% of an anionic detergent, 6 to 50% of a cosurfactant, 0.1% to 10% of a grease release agent, 0.4% to 10% of perfume and the balance being water as well as all purpose hard surface cleaning composition or light duty liquid detergent compositions which contain a grease release agent.

5 Claims, No Drawings

LIQUID CLEANING COMPOSITIONS

This invention relates to an improved all-purpose liquid cleaner designed in particular for cleaning hard surfaces and which is effective in removing grease soil and/or other soils and in leaving unrinsed surfaces such as wood with a shiny appearance as well as to an all purpose hard surface cleaner.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc.. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of environmentalists' efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase. In view of the extremely fine particle size of the dispersed oil phase particles, microemulsions are transparent to light and are clear and usually highly stable against phase separation.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) lying in the range of 5:1 to 1:3; and (c) from about 0.5% about 10% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

SUMMARY OF THE INVENTION

The present invention provides improved, clear, liquid cleaning compositions having improved interfacial tension which improves cleaning hard surface which can be in the form of a microemulsion which is suitable for cleaning hard surfaces such as plastic, wood, vitreous and metal surfaces having a shiny finish or in the form of an all purpose hard surface cleaner.

More particularly, the improved cleaning compositions exhibit good soil removal properties due to the improved interfacial tensions, when used in undiluted (neat) form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products.

In one aspect, the invention generally provides a stable, clear all-purpose, hard surface cleaning composition especially effective in the removal of oily and greasy oil, which is in the form of a substantially dilute oil-in-water microemulsion having an aqueous phase and an oil phase; The dilute o/w microemulsion includes, on a weight basis:

from about 0.1% to 7% by weight of a nonionic surfactant;

from about 2% to 35% by weight of a tall oil fatty acid;

from 1.0% to about 50% of a water-mixable cosurfactant having either limited ability or substantially no ability to dissolve oily or greasy soil;

from about 1% to about 14% of triethanolamine;

0.1 to 10% of a hydrotrope;

0.4 to 25% of a perfume or water insoluble hydrocarbon or d-limonene; and 10 to 85% of water, said proportions being based upon the total weight of the composition. Quite surprisingly although the perfume is not, per se, a solvent for greasy or oily soil, —even though some perfumes may, in fact, contain as much as about 80% of terpenes which are known as good grease solvents.

DETAILED DESCRIPTION OF THE INVENTION

The present invention relates to a stable microemulsion composition approximately by weight: 2% to 35% of a tall oil fatty acid, 0.1% to 7% of a nonionic surfactant, 0.1% to 50% of a cosurfactant, 0.1% to 10% of a hydrotrope, 0 to 4% of potassium hydroxide, 1% to 14% of a triethanolamine, 0.1% to 25% of a water insoluble hydrocarbon or a perfume and the balance being water.

According to the present invention, the role of the hydrocarbon can be provided by d-limonene or a non-water-soluble perfume. Typically, in aqueous based compositions the presence of a solubilizer, such as alkali metal lower alkyl aryl sulfonate hydrotrope, triethanolamine, urea, etc., is required for perfume dissolution, especially at perfume levels of about 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both clear (as a consequence of the formation of a microemulsion) and highly fragranced (as a consequence of the perfume level).

Second, an improved soil release effect and an improved grease removal capacity in neat (undiluted) usage of the dilute aspect or after dilution of the concentrate can be obtained without detergent builders or buffers or conventional grease removal solvents at neutral or acidic pH and at low levels of active ingredients while improved cleaning performance can also be achieved in diluted usage.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume or d-limonene is present in the dilute o/w microemulsion in an amount of from about 0.4% to about 25% by weight, preferably from about 1% to about 20% by weight, especially preferably from about 2% to about 18% by weight. If the amount of hydrocarbon (perfume) is less than about 0.4% by weight it becomes difficult to form the o/w microemulsion.

Furthermore, although superior soil removal performance will be achieved for perfume compositions not containing any terpene solvents, it is apparently difficult for perfumers to formulate sufficiently inexpensive perfume compositions for products of this type (i.e., very cost sensitive consumer-type products) which includes less than about 20%, usually less than about 30%, of such terpene solvents.

Thus, merely as a practical matter, based on economic consideration, the dilute detergent cleaning compositions of the present invention may often include as much as about 0.2% to about 7% by weight, based on the total composition, of terpene solvents introduced thereunto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted compositions.

In place of the perfume one can employ d-limonene a water insoluble paraffin or isoparaffin having about 6 to about 18 carbon at a concentration of about 0.4 to about 25 wt. percent, more preferably 1 to 20 wt. %.

The preferred long chain unsaturated fatty acids of the instant invention have about 8 to about 24 carbon atoms, more preferably about 10 to about 20 carbon atoms. A preferred unsaturated fatty acid mixture is a refined tall oil fatty acid. A typical tall oil fatty acid contains mono unsaturated $C_{16-18}$ fatty acid; a $C_{18}$ diene unsaturated fatty acid; a $C_{16-18}$ triene unsaturated fatty acid; and a $C_{16-18}$ saturated fatty acid. Other unsaturated fatty acids that are usable in the instant compositions are unsaturated vegetable oil fatty acids, including soy, peanut, corn, cottonseed, linseed and refined oleic fatty acids, and fatty acids consisting predominantly of $C_{18}$ (average) unsaturated fatty acids and mixtures thereof. The unsaturated fatty acid reacts in situ with the triethanol amine and potassium hydroxide to form the triethanol amine salt of the unsaturated fatty acid. The concentration of the unsaturated fatty acid is about 2 to about 35 wt. %, more preferably about 4 to about 25 wt. % and most preferably about 6 to about 18 wt. %. The alkali metal hydroxide is preferably potassium hydroxide and is present in the composition at a concentration of about 1 to about 5 wt. %, more preferably about 1.2 to about 4.5 wt. % and most preferably about 1.5 to about 4 wt. %. The potassium hydroxide reacts in situ with the fatty acid in the composition to form the potassium salt of the fatty acid.

The cosurfactant may play an essential role in the formation of the dilute o/w microemulsion and the concentrated microemulsion compositions. Very briefly, in the absence of the cosurfactant the water, detergent(s) and hydrocarbon (e.g., perfume) will, when mixed in appropriate proportions form either a miceliar solution (low concentration) or form an oil-in-water emulsion in the first aspect of the invention. With the cosurfactant added to this system, the interfacial tension at the interface between the emulsion droplets and aqueous phase is reduced to a very low value (never negative). This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized. Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity of the interfacial film.

The major class of compounds which has been found to provide highly suitable cosurfactants over temperature ranges extending from 5° C. to 43° C. for instance; (1) water-soluble $C_3$–$C_4$ alkanols, polypropylene glycol of the formula $HO(CH_3CHCH_2O)_nH$ wherein n is a number from 2 to 18 and monoalkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_3CHCH_2)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol propionate.

While all of the aforementioned glycol ether compounds provide the described stability, the most preferred cosurfactant compound of each type, on the basis of cost and cosmetic appearance (particularly odor), is propylene glycol tetrabutyl ether The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above. Generally, amounts of cosurfactant in the range of from 0.1% to 50%, preferably from about 0.5% to 15%, especially preferably from about 1% to 7%, by weight provide stable dilute o/w microemulsions for the above-described levels of primary sudactants and perfume and any other additional ingredients as described below.

The ability to formulate products without builders which have soil removal capacities is a feature of the present invention because the prior art o/w microemulsion formulations most usually are highly alkaline or highly built or both.

In addition to their excellent capacity for cleaning greasy and oily soils, the o/w microemulsion formulations also exhibit excellent cleaning performance and removal of soap scum and lime scale in neat (undiluted) as well as in diluted usage.

The composition contains 0.1 to 10 wt. % of a hydrotrope such as sodium cumene sulfonate or sodium xylene sulfonate.

The final essential ingredient in the inventive microemulsion compositions having improved interfacial tension properties is water. The proportion of water in the microemulsion compositions generally is in the range of 20% to 70%, preferably 35% to 55% by weight of the usual diluted o/w microemulsion composition.

As believed to have been made clear from the foregoing description, the dilute o/w microemulsion liquid all-purpose cleaning compositions of this invention are especially effective when used as is, that is, without further dilution in water, since the properties of the composition as an o/w microemulsion are best manifested in the neat (undiluted) form. However, at the same time it should be understood that depending on the levels of surfactants, cosurfactants, perfume (hydrocarbon) and other ingredients, some degree of dilution without disrupting the microemulsion, per se, is possible. For example, at the preferred low levels of active surfactant compounds (i.e., primary anionic and nonionic detergents) dilutions up to about 50% will generally be well tolerated without causing phase separation, that is, the microemulsion state will be maintained.

However, even when diluted to a great extent, such as a 2- to 10-fold or more dilution, for example, the resulting compositions are still effective in cleaning greasy, oily and other types of soil. Furthermore, the presence of magnesium ions or other polyvalent ions, e.g., aluminum, as will be described in greater detail below further serves to boost cleaning performance of the primary detergents in dilute usage.

On the other hand, it is also within the scope of this invention to formulate highly concentrated microemulsions which will be diluted with additional water before use.

In addition to the above-described essential ingredients required for the formation of the microemulsion composition, the compositions of this invention may often and preferably do contain one or more additional ingredients which serve to improve overall product performance.

The microemulsion composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitrodioxan-1,3; 5-chloro- 2-methyl-4-isothaliazolin-3-one, 2,6-di-tert butyl-p-cresol, etc., in amounts up to 2% by weight.

In final form, the oil-in-water microemulsions exhibit stability at reduced and increased temperatures. More specifically, such compositions remain clear and stable in the range of 5° C. to 50° C., especially 10° C. to 43° C. Such compositions exhibit a pH of 8 to 10 depending on intended end use. The liquids are readily pourable and exhibit a Brookfield viscosity in the range of 10 to 300 cps as measured at 25° C. with a Brookfield RVT Viscometer using a #3 spindle rotating at 20 RPM. Preferably, the viscosity is maintained in the range of 10 to 100 cps.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

Because the compositions as prepared are aqueous liquid formulations and since no particular mixing is required to form the o/w microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume.

The nonionic surfactant can be present in the light duty liquid detergent composition in amounts of about 0.1 to 7%, preferably 0.5 to 5%, by weight of the detergent composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent The nonionic detergent class includes the condensation products of a higher alcohol (e.g., an alkanol containing about 8 to 18 carbon atoms in a straight or branched chain configuration) condensed with about 1 to 12 moles of ethylene oxide, for example, lauryl or myristyl alcohol condensed with about 3 moles of ethylene oxide (EO), tridecanol condensed with about 6 to moles of EO, myristyl alcohol condensed with about 9 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with an average of 2.5 moles of ethylene oxide (Neodol 91-2.5), $C_{12-15}$ alkanol condensed with 3 moles ethylene oxide (Neodol 25-3), $C_{12-15}$ alkanol condensed with 7 moles ethylene oxide (Neodol 25-7), $C_{14-15}$ alkanol condensed with 7 moles ethylene oxide (Neodol 45-7, and the like. Such ethoxamers have an HLB (hydrophobic lipophilic balance) value of about 8 to 13 and give good O/W emulsification.

Additional satisfactory water soluble alcohol ethylene oxide condensates are the condensation products of a secondary aliphatic alcohol containing 8 to 18 carbon atoms in a straight or branched chain configuration condensed with 5 to 15 moles of ethylene oxide. Examples of commercially available nonionic detergents of the foregoing type are $C_{11}$–$C_{15}$ secondary alkanol condensed with either 7 EO (Tergitol 15-S-7) or 9 EO (Tergitol 15-S-9) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic sudactants of this type include Igepal CO-630 (nonyl phenol ethoxylate) marketed by GAF Corporation.

Also among the satisfactory nonionic detergents are the water-soluble condensation products of a C8–C20 alkanol with a heteric mixture of ethylene oxide and propylene oxide wherein the weight ratio or ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70 to 80%, by weight. Such detergents are commercially available from BASF-Wyandotte and a particularly preferred detergent is a C10–C16 alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described cleanser. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents which are less preferred are marketed under the trade name "Pluronics". The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The following examples are merely illustrative of the invention and are not to be construed as limiting thereof.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

Example 1

The following microemulsion compositions in wt. % were prepared:

| | A | B |
|---|---|---|
| Tall oil fatty acid | 12.3 | 12.0 |
| D-Limonene | 16.2 | 18.0 |
| Triethanol amine | 8.2 | 8.0 |
| Propylene glycol t-butyl ether | 5.9 | 6.0 |
| Sodium xylene sulfonate | 2.4 | 6.0 |
| $C_{9-11}$ alcohol EO 2.5:1 | 2.0 | 2.0 |

-continued

| | A | B |
|---|---|---|
| KOH (45%) | 4.0 | 4.0 |
| Water | balance | balance |
| pH | 8.8 | 9 |
| Brookfield viscosity RT, #3 spindle, 20 rpms | | 50 cps |

In summary, the described invention broadly relates to an improvement in microemulsion compositions containing a fatty acid, a nonionic surfactant, triethanol amine, a hydrotrope, a cosurfactant, a hydrocarbon ingredient and water which comprise the use of a water-insoluble, hydrocarbon or odoriferous perfume or d-limonene as the essential hydrocarbon ingredient in a proportion sufficient to form either a dilute o/w microemulsion composition containing, by weight, 2% to 35% of a fatty acid, 1 to 7% of a nonionic surfactant, 0.1% to 14% of triethanol amine, 1% to 50% of cosurfactant, 0.1 to 10% of a hydrotrope, 0 to 4% of potassium hydroxide, 0.4% to 25% of perfume or hydrocarbon and the balance being water as well as to the previously described all purpose hard surface cleaner.

What is claimed:

1. A stable microemulsion composition consisting essentially of approximately by weight:

(a) 6% to 18% of a $C_{16-18}$ unsaturated fatty acid;

(b) 1% to 7% of a nonionic surfactant selected from the group consisting of primary aliphatic alcohol ethoxylates, secondary aliphatic alcohol ethoxylates, alkyl phenol ethoxylates, ethylene oxide propylene oxide condensates with primary alcohols and condensates of ethylene oxide with sorbitan fatty acid esters;

(c) 0.1% to 10% of a hydrotrope selected from the group consisting of sodium cumene sulfonate and sodium xylene sulfonate;

(d) 0.1% to 50% of a cosurfactant selected from the group consisting of $C_{3-4}$ alkanols, polypropylene glycol of the formula $HO(CH_3CHCH_2O)_nH$, wherein n is a number from 2 to 18, monoalkyl ethers and esters having the formulas $R(X)_mOH$ and $R_1(X)_mOH$ wherein R is a $C_1$–$C_6$ alkyl group, $R_1$ is a $C_2$–$C_4$ acyl group and m is a number from 1 to 4;

(e) 1% to 14% of triethanol amine;

(f) 0.4% to 25% of an oil phase consisting of a water insoluble perfume or a $C_{6-18}$ water insoluble paraffin or isoparaffin; and (g) the balance being water, where said composition does not contain builder.

2. The cleaning composition of claim 1 wherein the cosurfactant is a water soluble glycol ether.

3. The cleaning composition of claim 1 wherein the glycol ether is selected from the group consisting of propylene glycol t-butyl ether, ethylene glycol monobutylether, diethylene glycol monobutyl ether, triethylene glycol monobutylether, poly-propylene glycol having an average molecular weight of from about 200 to 1,000 and propylene glycol tert butyl ether, mono, di, tri propylene glycol monobutyl ether.

4. The cleaning composition of claim 1 wherein the glycol ether is propylene glycol tetra butyl ether.

5. The cleaning composition of claim 1 further including 0. 1 to 4 wt. % of potassium hydroxide.

* * * * *